US008547371B2

(12) United States Patent
Tanikame et al.

(10) Patent No.: US 8,547,371 B2
(45) Date of Patent: Oct. 1, 2013

(54) DISPLAY APPARATUS, DRIVING METHOD OF DISPLAY APPARATUS AND ELECTRONIC EQUIPMENT

(75) Inventors: Takao Tanikame, Kanagawa (JP); Yukihito Iida, Kanagawa (JP); Tetsuo Minami, Tokyo (JP); Katsuhide Ucnino, Kanagawa (JP)

(73) Assignee: Sony Corporation, Tokyo (JP)

( * ) Notice: Subject to any disclaimer, the term of this patent is extended or adjusted under 35 U.S.C. 154(b) by 319 days.

(21) Appl. No.: 12/449,153

(22) PCT Filed: Jan. 7, 2008

(86) PCT No.: PCT/JP2008/050024

§ 371 (c)(1),
(2), (4) Date: Apr. 12, 2010

(87) PCT Pub. No.: WO2008/096555

PCT Pub. Date: Aug. 14, 2008

(65) Prior Publication Data

US 2010/0214276 A1 Aug. 26, 2010

(30) Foreign Application Priority Data

Feb. 2, 2007 (JP) ..... P2007-023893

(51) Int. Cl.
*G09G 5/00* (2006.01)

(52) U.S. Cl.
USPC ..... 345/211; 345/76; 345/83

(58) Field of Classification Search
USPC ..... 345/76–83, 211
See application file for complete search history.

(56) References Cited

U.S. PATENT DOCUMENTS

2006/0158412 A1* 7/2006 Morita ..... 345/94
2006/0170628 A1* 8/2006 Yamashita et al. ..... 345/76

FOREIGN PATENT DOCUMENTS

JP 2003-216110 A 7/2003
JP 2003-271095 A 9/2003
JP 2004-295131 A 10/2004
JP 2005-04173 A 1/2005
JP 2005-189388 A 7/2005
JP 2005-215102 A 8/2005
JP 2005-345723 A 12/2005

(Continued)

OTHER PUBLICATIONS

International Search Report; International Application No. PCT/JP2008/050024; Date: Mar. 18, 2008.

(Continued)

*Primary Examiner* — Amare Mengistu
*Assistant Examiner* — Premal Patel
(74) *Attorney, Agent, or Firm* — Rader, Fishman & Grauer PLLC

(57) ABSTRACT

Prior to increasing the voltage level of an input signal to be sampled in a step-by-step manner and writing a signal voltage Vsig at a desired voltage level, a precharge is performed which writes a precharge voltage Vpre, lower than the signal voltage Vsig, so as to apply the same voltage Vpre to the gate of a drive transistor in advance. This not only provides a reduced gate-to-source voltage of the drive transistor at the time of writing of the signal voltage Vsig but also extends a mobility correction time required for a mobility correction operation. The extension of the mobility correction time required for the mobility correction operation ensures a relatively smaller variation in the correction time, thus suppressing the variation in brightness. The extension also permits a write pulse to be set to the optimal pulse width.

9 Claims, 12 Drawing Sheets

(56) References Cited

FOREIGN PATENT DOCUMENTS

| | | | |
|---|---|---|---|
| JP | 2006-133542 | A | 5/2006 |
| JP | 2006-215213 | A | 8/2006 |
| JP | 2007-156460 | A | 6/2007 |

OTHER PUBLICATIONS

Japanese Office Action issued Dec. 6, 2012 for corresponding Japanese Application No. 2007-023893.

* cited by examiner (A)

(B)

DISPLAY APPARATUS, DRIVING METHOD OF DISPLAY APPARATUS AND ELECTRONIC EQUIPMENT

TECHNICAL FIELD

The present invention relates to a display apparatus, a driving method of the display apparatus and electronic equipment. The present invention relates particularly to a flat panel display apparatus having pixels including light-emitting elements arranged in a matrix form, a driving method of the display apparatus and electronic equipment having the display apparatus.

BACKGROUND ART

In the field of image display apparatuses, recent years have seen the development and commercialization of flat panel display apparatuses having pixels (pixel circuits) including light-emitting elements arranged in a matrix form. Among such display apparatuses are organic EL display apparatuses using organic EL (electro luminescence) elements as the light-emitting elements of the pixels. The organic EL element is an example of so-called current-driven light-emitting elements whose emission brightness changes with change in current flowing through the element. The organic EL element relies on the phenomenon that the organic thin film thereof emits light when an electric field is applied thereto.

Such organic EL display apparatuses offer low power consumption thanks to their organic EL elements which can be driven by an applied voltage of 10 V or less. Further, organic EL elements are self-luminous. This makes organic EL display apparatuses more advantageous than liquid crystal display apparatuses designed to display an image by controlling the light intensity from the light source (backlight) for each pixel including a liquid crystal cell using the cell. Such advantages include high image visibility and ease of reduction in weight and thickness thanks to no need for illuminating members such as backlight which are necessary for liquid crystal display apparatuses. Further, organic EL elements offer extremely high response speed or approximately several μ seconds. As a result, organic EL display apparatuses produce no afterimage during display of a moving image.

As with liquid crystal display apparatuses, organic EL display apparatuses can be driven by passive or active matrix. It should be noted, however, that although passive matrix display apparatuses are simple in structure, they have disadvantages including difficulties in implementing a large-size, high-definition display apparatus. Therefore, the development of active matrix display apparatuses has been brisk in recent years. In such display apparatuses, the current flowing through the light-emitting element is controlled by an active element provided together with the light-emitting element in the same pixel circuit such as insulated gate electric field effect transistor (generally TFT (Thin Film Transistor)).

Incidentally, the I-V characteristic (current vs voltage characteristic) of organic EL elements is generally known to deteriorate with time (so-called secular deterioration). In a pixel circuit using an N-channel TFT as a transistor adapted to drive an organic EL element (hereinafter described as "drive transistor") by a current, the organic EL element is connected to the source of the drive transistor. Therefore, secular deterioration of the I-V characteristic of the organic EL element leads to a change in a gate-to-source voltage Vgs of the drive transistor, thus changing the emission brightness of the organic EL element.

A more detailed description thereof will be given below. The source potential of a drive transistor is determined by the operating point of the drive transistor and the organic EL element. In the event of a deterioration of the I-V characteristic of the organic EL element, the operating point of the drive transistor and the organic EL element changes. This leads to a change in the source potential of the drive transistor even if the same potential is applied to the gate of the drive transistor. As a result, the gate-to-source voltage Vgs of the drive transistor changes, changing the current flowing through the drive transistor. This changes the current flowing through the organic EL element, changing the emission brightness of the organic EL element.

With a pixel circuit using a polysilicon TFT, on the other hand, a threshold voltage Vth of the drive transistor and a mobility μ of the semiconductor thin film making up the channel of the drive transistor change with time in addition to the secular deterioration of the I-V characteristic of the organic EL element. Moreover, the threshold voltage Vth and the mobility μ may be different between different pixels due to a manufacturing process variation (that is, different transistors exhibit different characteristics).

In the event of a difference in the threshold voltage Vth of the drive transistor or the mobility μ, the current flowing through the drive transistor changes. This leads to a change in emission brightness of the organic EL element between different pixels even if the same voltage is applied to the gate of the drive transistor, thus impairing the uniformity over the screen.

For this reason, each of the pixel circuits has various compensation and correction functions to ensure that the emission brightness of the organic EL element remains constant even in the event of a secular deterioration of the I-V characteristic of the organic EL element or a secular change in the threshold voltage Vth or the mobility μ of the drive transistor without being affected by such a change or deterioration. One of the functions is the compensation function adapted to compensate for the change in characteristic of the organic EL element. Another function is the correction function adapted to correct the change in the threshold voltage Vth of the drive transistor (hereinafter written as "threshold correction"). Still another function is the correction function adapted to correct the mobility μ of the drive transistor (hereinafter written as "mobility correction") (refer, for example, to Japanese Patent Laid-Open No. 2006-133542).

DISCLOSURE OF INVENTION

In the prior art described in Japanese Patent Laid-Open No. 2006-133542, each pixel circuit has the compensation function adapted to compensate for the change in characteristic of the organic EL element and the correction functions adapted to correct the change in the threshold voltage Vth and the mobility μ of the drive transistor. As a result, the emission brightness of the organic EL element remains constant in the event of a secular deterioration of the I-V characteristic of the organic EL element or a secular change in the threshold voltage Vth or the mobility μ of the drive transistor without being affected by such a change or deterioration. However, each pixel circuit includes a large number of elements, thus posing a hurdle for the reduction of the pixel size.

A possible solution to reducing the number of elements and interconnections making up the pixel circuit would be to ensure that a supply potential supplied to the drive transistor of the pixel circuit can be changed. In this manner, the drive transistor would be capable of controlling the emission and non-emission periods of the organic EL element by changing the supply potential. As a result, the transistor adapted to control the emission and non-emission periods could be omitted.

This technique makes it possible to configure a pixel circuit with the minimum required number of elements. That is, a pixel circuit can be made up of a write transistor configured to sample an input signal voltage and write the voltage to the pixel, a holding capacitance configured to hold the input signal voltage written by the write transistor, and a drive transistor configured to drive the light-emitting element based on the input signal voltage held by the holding capacitance.

As described above, if the drive transistor serves also as a transistor configured to control the emission and non-emission periods of the organic EL element in order to reduce the number of elements making up the pixel circuit, the above mobility correction is carried out simultaneously with the writing of the input signal voltage by the write transistor. Incidentally, in the prior art described in Japanese Patent Laid-Open No. 2006-133542, the mobility correction is performed after the write period of the input signal voltage is totally complete.

Here, the mobility correction operation is determined by the gate-to-source voltage Vgs of the drive transistor at the beginning of the correction and the operation time (mobility correction time). And, there is a relationship between the optimal mobility correction time for the mobility correction to provide the best image quality and the gate-to-source voltage Vgs of the drive transistor at the beginning of the correction. That is, the higher the gate-to-source voltage Vgs, the shorter the optimal mobility correction time.

On the other hand, the mobility correction time is determined only by the pulse width of a write pulse adapted to sample and write the input signal voltage to the pixels (pulse adapted to drive the write transistor). Therefore, even if there is a variation in pulse width of a write pulse by the same amount of time between the long and short optimal mobility correction times, the variation in pulse width of a write pulse is relatively large when the optimal mobility correction time is short. The variation in pulse width leads to variation in brightness, thus resulting in degraded image quality.

Further, when the optimal mobility correction time is short, the write pulse width can be determined only discontinuously because of the system adapted to determine this pulse width. More specifically, the write pulse width can be determined only in the unit of pulse width of the master clock based on which the system operates. As a result, it is probable that the optimal setting may not be achieved.

In light of the foregoing, it is an object of the present invention to provide a display apparatus, driving method of the display apparatus and electronic equipment using the same for providing a relatively smaller variation in mobility correction time required for a mobility correction operation by extending the mobility correction time so as to suppress the variation in brightness and permit a write pulse to be set to the optimal pulse width.

In order to achieve the above object, a display apparatus according to the present invention includes a pixel array section and write scan circuit. The pixel array section has pixels arranged in a matrix form. Each of the pixels includes a light-emitting element, write transistor, holding capacitor and drive transistor. The write transistor samples and writes an input signal voltage. The holding capacitor holds the input signal voltage written by the write transistor. The drive transistor drives the light-emitting element based on the input signal voltage held by the holding capacitor. The write scan circuit supplies a write pulse adapted to drive the write transistor to the pixels in the pixel array section on a row-by-row basis. The pixels in the row scanned by the write scan circuit are supplied with the input signal voltage. The level of the input signal voltage is increased in a step-by-step manner.

In the display apparatus configured as described above and electronic equipment using the same, there is a relationship between the optimal mobility correction time for the mobility correction to provide the best image quality and the gate-to-source voltage of the drive transistor at the beginning of the correction. That is, the higher the gate-to-source voltage Vgs, the shorter the optimal mobility correction time. In other words, the lower the gate-to-source voltage Vgs, the longer the optimal mobility correction time.

Therefore, prior to increasing the voltage level of the input signal to be sampled in a step-by-step manner and writing the signal voltage at a desired voltage level, a voltage lower than the signal voltage is written in advance (also referred to as the precharge). This raises the gate potential of the drive transistor, also causing the source potential to rise. As a result, the gate-to-source voltage of the drive transistor at the time of writing of the input signal voltage at a desired level, i.e., at the beginning of a mobility correction period, can be kept lower than if the precharge were not performed. This provides a longer optimal mobility correction time (extends the mobility correction time longer than if the precharge were not performed).

BEST MODE FOR CARRYING OUT THE INVENTION

The preferred embodiments of the present invention will be described in detail below with reference to the accompanying drawings.

Figure 1:
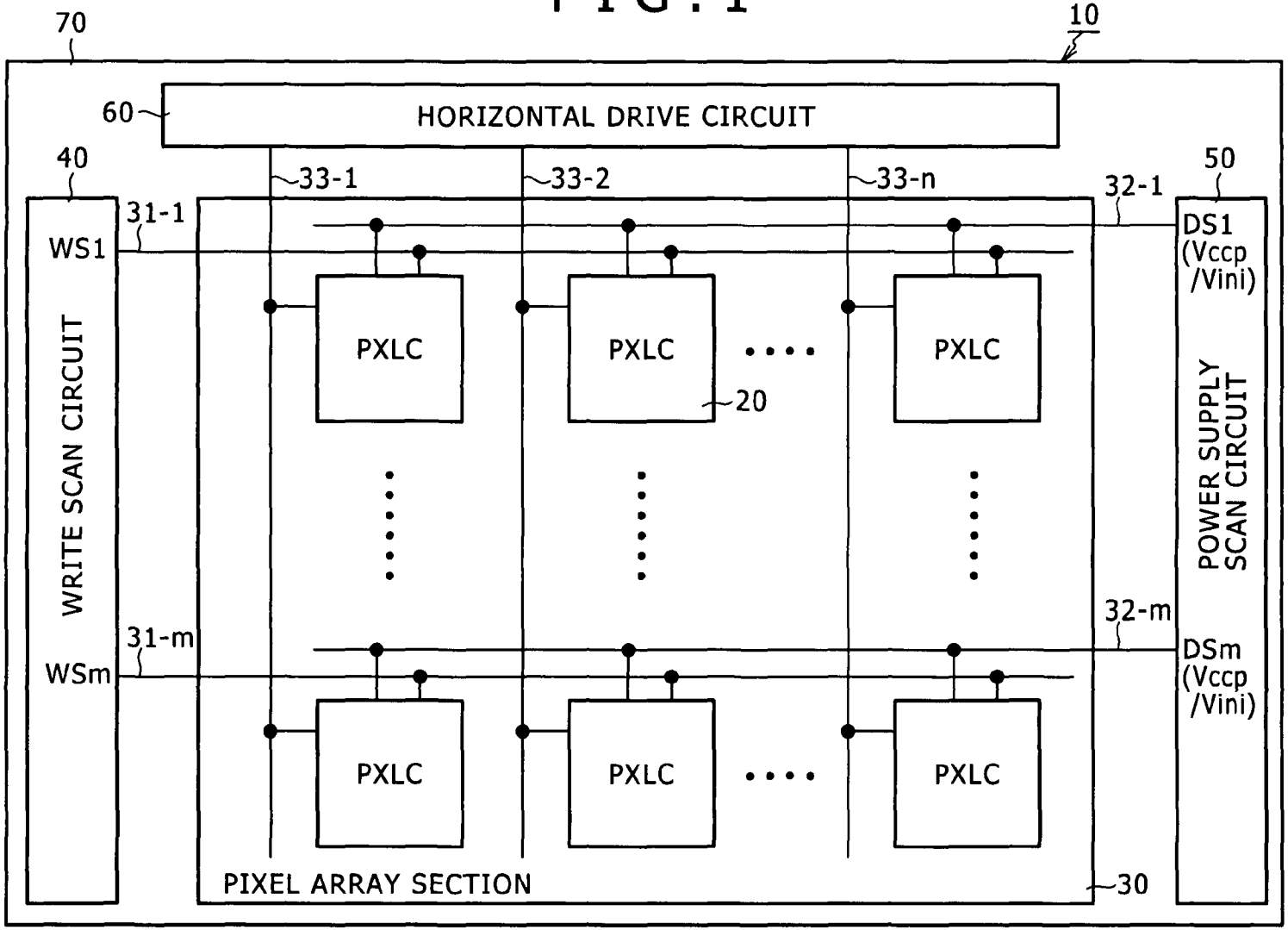
FIG. 1 is a system configuration diagram illustrating the schematic configuration of an organic EL display apparatus according to an embodiment of the present invention.

FIG. 1 is a system configuration diagram illustrating the schematic configuration of an active matrix display apparatus according to an embodiment of the present invention. Here, a description will be given, as an example, about an active matrix organic EL display apparatus. This EL display apparatus uses organic EL elements as light-emitting elements of pixels. The organic EL element is an example of so-called current-driven light-emitting elements whose emission brightness changes with change in current flowing through the element.

As illustrated in FIG. 1, an organic EL display apparatus 10 according to the present embodiment includes a pixel array section 30 and drive sections disposed around the pixel array section 30 such as a write scan circuit 40, a power supply scan circuit 50 and a horizontal drive circuit 60. The pixel array section 30 has pixels (PXLC) 20 arranged two-dimensionally in a matrix form. The drive sections, namely, the write scan, power supply scan and horizontal drive circuits 40, 50 and 60 drive each of the pixels 20.

The pixel array section 30 has, in an m by n pixel array, scan lines 31-1 to 31-m and power supply lines 32-1 to 32-m, one each for each pixel row. The pixel array section 30 also has signal lines 33-1 to 33-n, one each for each pixel column.

The pixel array section 30 is normally formed on a transparent insulated substrate such as glass substrate and has a flat panel construction. Each of the pixels 20 of the pixel array section 30 can be formed with amorphous silicon TFT (Thin Film Transistor) or low-temperature polysilicon TFT. When low-temperature polysilicon TFT is used, the write scan circuit 40, the power supply scan circuit 50 and the horizontal drive circuit 60 can also be incorporated on the display panel (substrate) 70 on which the pixel array section 30 is formed.

The write scan circuit 40 includes a shift register or other components. To write a video signal to the pixels 20 of the pixel array section 30, the write scan circuit 40 supplies sequential scan signals WS1 to WSm to the scan lines 31-1 to 31-m to perform a linear sequential scan of the pixels 20 on a row by row basis.

The power supply scan circuit 50 includes a shift register or other components. The same circuit 50 supplies power supply line potentials DS1 to DSm to the power supply lines 32-1 to 32-m in synchronism with the linear sequential scan by the write scan circuit 40. The power supply line potentials DS1 to DSm switch between a first potential Vccp and a second potential Vini which is lower than the first potential Vccp. Here, the second potential Vini is sufficiently lower than an offset voltage Vofs applied by the horizontal drive circuit 60.

The horizontal drive circuit 60 selects either of a signal voltage Vsig of the video signal, commensurate with brightness information supplied by a signal supply source (not shown), and the offset voltage Vofs of the video signal as a reference voltage. Then, the same circuit 60 writes the selected voltage, for example, on a column by column basis, to the pixels 20 of each column of the pixel array section 30 all at once via the signal lines 33-1 to 33-n. That is, the same circuit 60 employs linear sequential driving adapted to write the input signal voltage Vsig, on a column by column (line by line) basis, to the pixels of each column all at once.

(Horizontal Drive Circuit)

Figure 2:
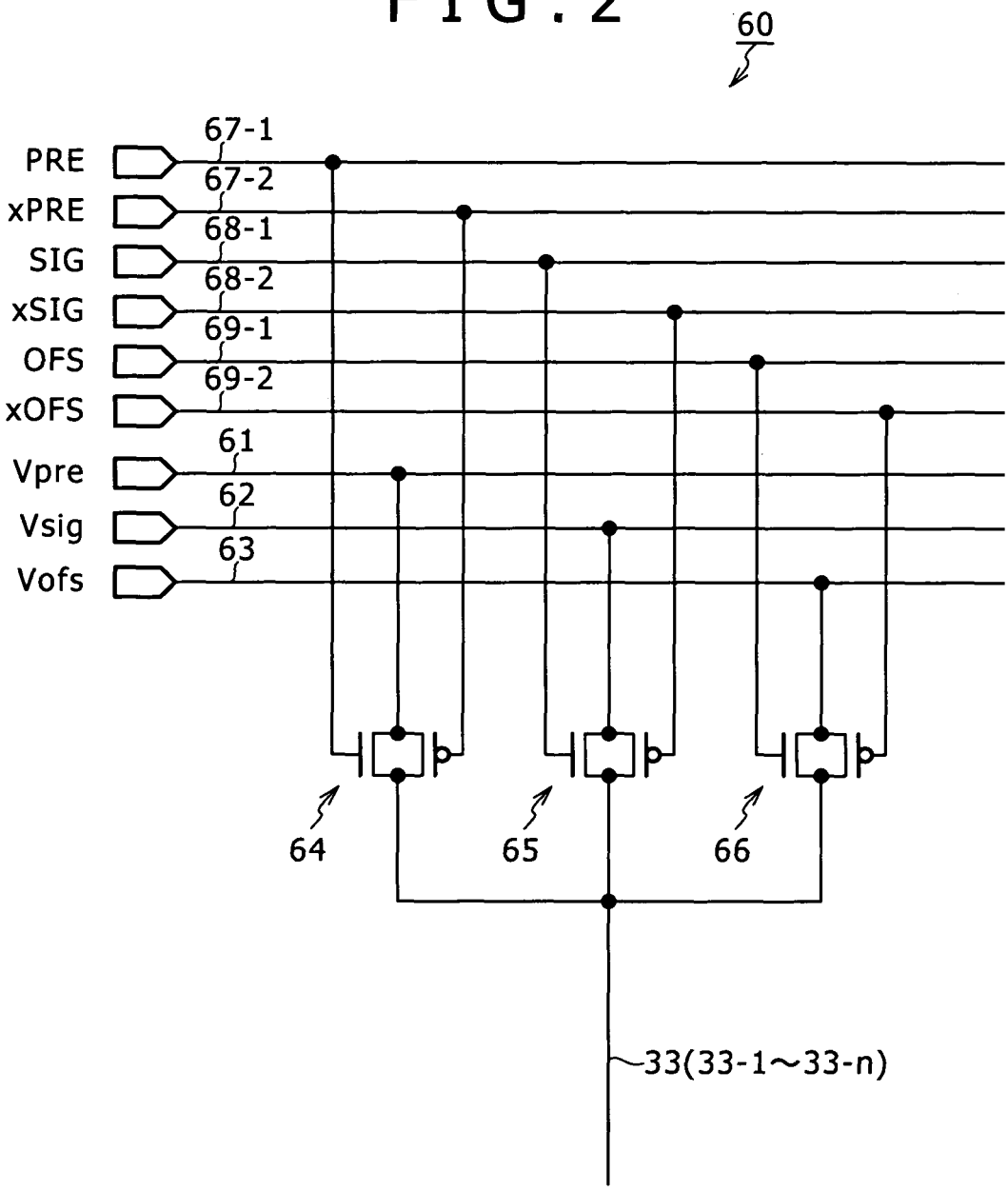
FIG. 2 is a circuit diagram illustrating an example of specific configuration of an output portion of a horizontal drive circuit.

FIG. 2 is a circuit diagram illustrating an example of specific configuration of an output portion of the horizontal drive circuit 60. Here, FIG. 2 illustrates only the circuit portion in a given row.

The horizontal drive circuit 60 includes at least one precharge signal line 61. The same circuit 60 also includes a video signal line 62 and a reference potential line 63. The same circuit 60 further includes horizontal selector switches 64, 65 and 66 which are connected between the lines 61, 62 and 63 and the signal lines 33 (33-1 to 33-n) of the pixel array section 30. Each of the horizontal selector switches 64, 65 and 66 includes, for example, a CMOS switch made up of an NMOS transistor and a PMOS transistor connected in parallel.

And, the horizontal selector switch 64 is controlled to turn on and off by switch control signals PRE and xPRE which are supplied via control lines 67-1 and 67-2. The switch control signals PRE and xPRE are opposite in phase to each other. The horizontal selector switch 65 is controlled to turn on and off by switch control signals SIG and xSIG which are opposite in phase to each other and are supplied via control lines 68-1 and 68-2. The horizontal selector switch 66 is controlled to turn on and off by switch control signals OFS and xOFS which are opposite in phase to each other and are supplied via control lines 69-1 and 69-2.

In the horizontal drive circuit 60 configured as described above, the horizontal selector switch 65 turns on in response to the switch control signals SIG and xSIG which are synchronous with the selection scan by the write scan circuit 40, supplying the signal voltage Vsig of the video signal, transmitted by the video signal line 62, to the signal line 33.

The horizontal selector switch 64 turns on in response to the switch control signals PRE and xPRE ahead of the supply of the signal voltage Vsig by the horizontal selector switch 65 to the signal line 33, supplying a precharge voltage Vpre, transmitted by the precharge signal line 61 and lower than the signal voltage Vsig, to the signal line 33 before the signal voltage Vsig.

The horizontal selector switch 66 turns on in response to the switch control signals OFS and xOFS during a period of time other than when the horizontal selector switches 64 and 65 are on, supplying an offset voltage Vofs, which is a reference voltage transmitted by the reference potential line 63, to the signal line 33.

As is clear from the above description, the horizontal drive circuit 60 supplies the input signal voltage to the pixels in the row scanned by the write scan circuit 40 via the signal lines 33 (33-1 to 33-n). At the same time, the same circuit 60 increases the voltage level of the input signal voltage in a step-by-step manner (in two steps in the present example). More specifically, the precharge voltage Vpre, lower than the signal voltage Vsig, is supplied before the signal voltage Vsig at a desired voltage level.

It should be noted that the horizontal drive circuit 60 according to the present embodiment increases the signal voltage in two steps, i.e., to the precharge voltage Vpre in the first step and to the signal voltage Vsig in the second step. However, the present invention is not limited to two steps, but a plurality of voltage levels may be specified as the precharge voltage Vpre so that the same voltage Vpre is supplied in a plurality of steps.

(Pixel Circuit)

Figure 3:
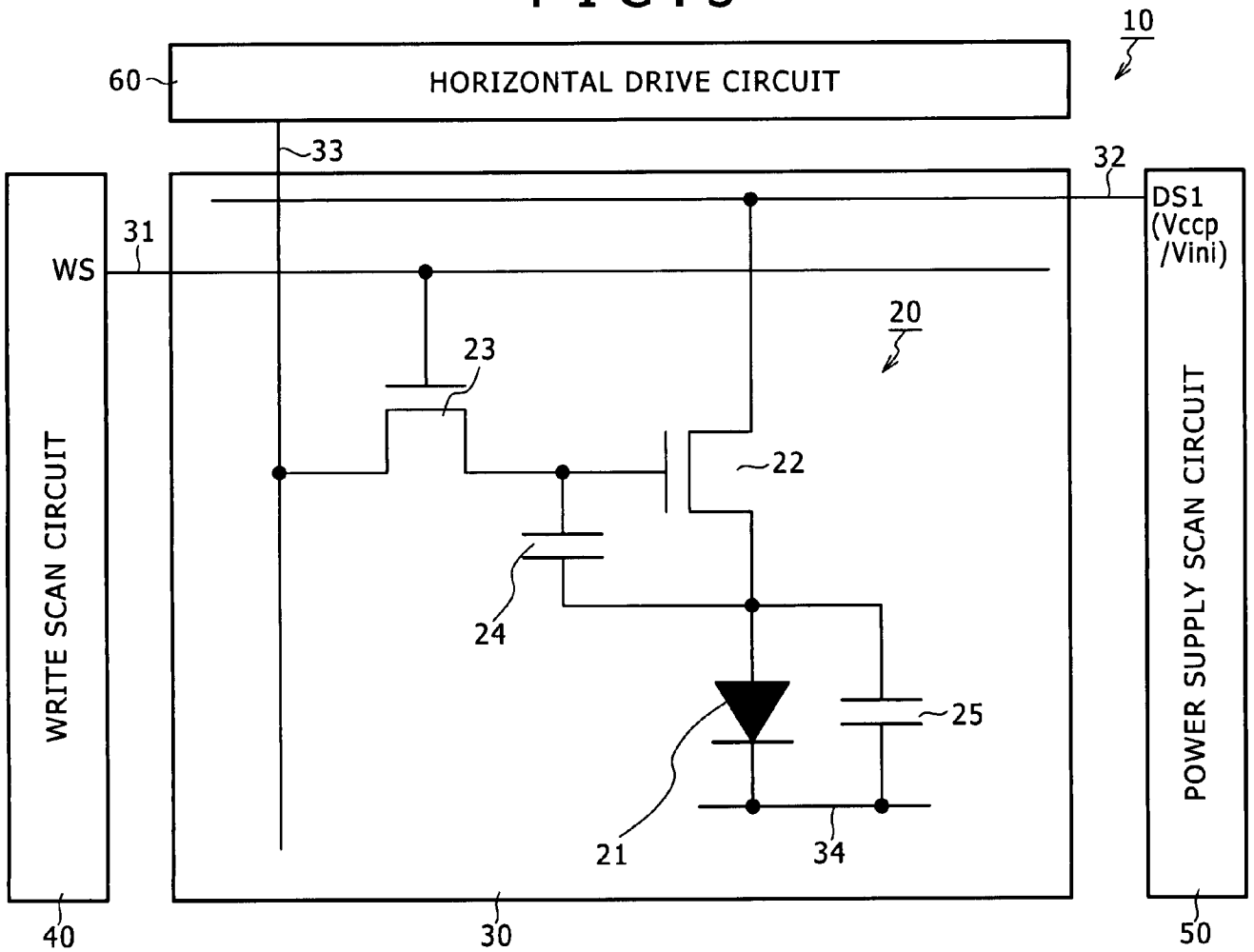
FIG. 3 is a circuit diagram illustrating a concrete configuration example of a pixel (pixel circuit)

FIG. 3 is a circuit diagram illustrating a concrete configuration example of the pixel (pixel circuit) 20. As illustrated in FIG. 3, the pixel circuit 20 includes an organic EL element 21 as a light-emitting element. The organic EL element is an example of so-called current-driven light-emitting elements whose emission brightness changes with change in current flowing through the elements. In addition to the organic EL element 21, the pixel circuit 20 includes a drive transistor 22, a write transistor 23, a holding capacitance 24 and an auxiliary capacitance 25.

Here, N-channel TFTs are used as the drive and write transistors 22 and 23. It should be noted, however, that the combination of conduction types of the drive and write transistors 22 and 23 given here is merely exemplary. The combination thereof is not limited to the above.

The organic EL element 21 has its cathode electrode connected to a common power supply line 34 which is shared by all the pixels 20. The drive transistor 22 has its source connected to the anode electrode of the organic EL element 21 and its drain to the power supply line 32 (any of 32-1 to 32-m).

The write transistor 23 has its gate connected to the scan line 31 (any of 31-1 to 31-m), its source to the signal line 33 (any of 33-1 to 33-n) and its drain to the gate of the drive transistor 22. The holding capacitance 24 has one of its ends connected to the gate of the drive transistor 22 and the other end to the source of the drive transistor 22 (anode electrode of the organic EL element 21).

The auxiliary capacitance 25 has one of its ends connected to the source of the drive transistor 22 and the other end to the cathode electrode of the organic EL element 21 (common power supply line 34). The auxiliary capacitance 25 is connected in parallel with the organic EL element 21, thus compensating for the lack of capacitance of the organic EL element 21. That is, the same capacitance 25 is not an absolutely necessary component, but instead may be omitted if the organic EL element 21 has sufficient capacitance.

In the pixel 20 configured as described above, the write transistor 23 conducts in response to the scan signal WS applied to its gate by the write scan circuit 40 via the scan line 31. As a result, the write transistor 23 samples either of the input signal voltage Vsig of the video signal, commensurate with brightness information, and the offset voltage Vofs of the video signal supplied by the horizontal drive circuit 60 via the signal line 33 and writes the selected voltage to the pixel 20. The written voltage, which is either the input signal voltage Vsig or the offset voltage Vofs, is held by the holding capacitance 24.

The drive transistor 22 is supplied with a current from the power supply line 32 (any of 32-1 to 32-m) when the potential DS of the same line 32 is at the first potential Vccp. As a result, the drive transistor 22 supplies a drive current, commensurate with the input signal voltage Vsig held in the holding capacitance 24, to the organic EL element 21, thus driving the same element 21 with a current.

(Pixel Structure)

Figure 4:
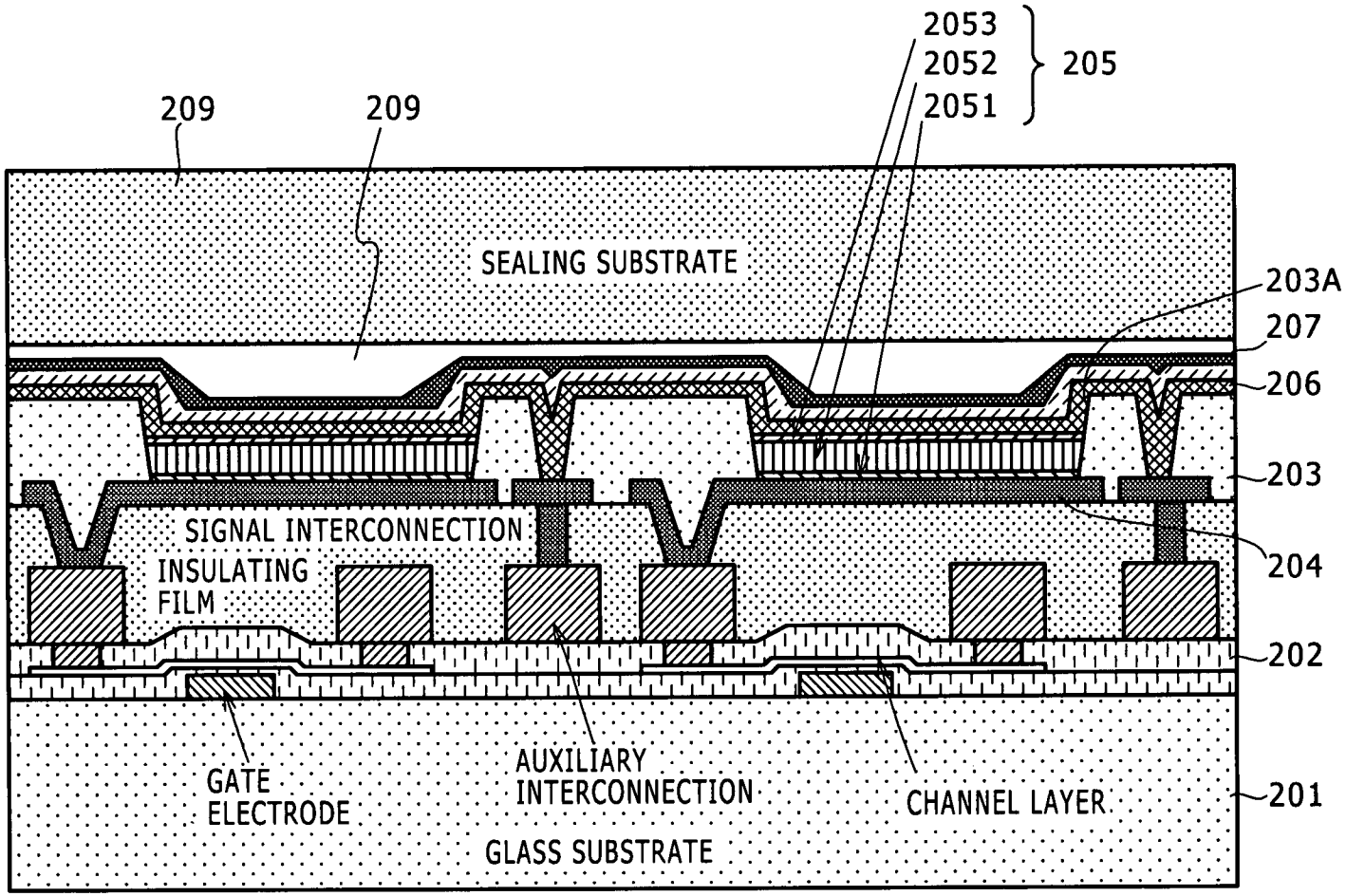
FIG. 4 is a sectional view illustrating an example of sectional structure of the pixel.

FIG. 4 illustrates an example of sectional structure of the pixel 20. As illustrated in FIG. 4, the pixel or pixel circuit 20 includes pixel circuits such as the drive and write transistors 22 and 23 formed on a glass substrate 201. On top of the pixel circuit, an insulating film 202 and a window insulating film 203 are formed. The organic EL element 21 is provided in a recessed portion 203A of the window insulating film 203.

The organic EL element 21 includes an anode electrode 204, an organic layer (electron transport layer, light-emitting layer, hole transport/injection layer) 205 formed on the anode electrode 204 and a cathode electrode 206 formed on the organic layer 205 for all the pixels. The anode electrode 204 includes, for example, a metal formed on the bottom of the recessed portion 203A of the window insulating film 203. The cathode electrode 206 includes, for example, a transparent electroconductive film.

In the organic EL element 21, the organic layer 205 is formed by successively depositing a hole transport/injection layer 2051, a light-emitting layer 2052, an electron transport layer 2053 and an electron injection layer (not shown) on top of the anode electrode 204. As the organic EL element 21 is driven with a current by the drive transistor 22 illustrated in FIG. 2, a current flows from the drive transistor 22 to the organic layer 205 via the anode electrode 204. This causes electrons and holes to recombine in the light-emitting layer 2052 of the organic layer 205, thus allowing the organic EL element 21 to emit light.

As illustrated in FIG. 4, after the organic EL element 21 is formed for each pixel on the glass substrate 201 via the insulating film 202 and the window insulating film 203, a sealing substrate 208 is bonded to the organic EL element 21 via a passivation film 207 with an adhesive 209. A display panel 70 is formed as the organic EL element 21 is sealed by the sealing substrate 208.

(Threshold Correction Function)

Here, the power supply scan circuit 50 switches the potential DS of the power supply line 32 between the first and second potentials Vccp and Vini after the write transistor 23 conducts while the horizontal drive circuit 60 supplies the offset voltage Vofs to the signal line 33 (any of 33-1 to 33-n). This switching of the potential DS of the power supply line 32 ensures that a voltage corresponding to the threshold voltage Vth of the drive transistor 22 is held by the holding capacitance 24.

The voltage corresponding to the threshold voltage Vth of the drive transistor 22 is held by the holding capacitance 24 for the following reason. That is, the characteristics of the drive transistor 22 such as the threshold voltage Vth and the mobility μ may change between different pixels due, for example, to a manufacturing process variation or secular change. Such a change leads to a change in the drain-to-source current (drive current) Ids between different pixels even if the same potential is applied to the gates of all the drive transistors 22. This results in a variation of the emission brightness. The holding capacitance 24 holds the voltage corresponding to the threshold voltage Vth to cancel (correct) the impact of variation of the threshold voltage Vth between different pixels.

The threshold voltage Vth of the drive transistor 22 is corrected in the following manner. That is, the holding capacitance 24 holds the threshold voltage Vth in advance. As a result, when the drive transistor 22 is driven by the input signal voltage Vsig, the threshold voltage Vth of the drive transistor 22 is canceled by the voltage corresponding to the threshold voltage Vth held by the holding capacitance 24. In other words, the threshold voltage Vth is corrected.

The threshold correction function works as described above. This function maintains the emission brightness of the organic EL element 21 unchanged even in the event of a variation of the threshold voltage Vth between different pixels or secular change without being affected by such a change or deterioration. The principle of the threshold correction function will be described in detail later.

(Mobility Correction Function)

The pixel 20 illustrated in FIG. 3 has not only the aforementioned threshold correction function but also the mobility correction function. That is, the mobility is corrected to cancel the dependence of the drain-to-source current Ids of the drive transistor 22 on the mobility μ during a mobility correction period when the holding capacitance 24 holds the input signal voltage Vsig. The mobility correction period is a period of time during which the horizontal drive circuit 60 supplies the signal voltage Vsig of the video signal to the signal line 33 (any of 33-1 to 33-n) and during which the write transistor 23 conducts in response to the scan signal WS (any of WS1 to WSm) from the write scan circuit 40. The detailed principle and operation of the mobility correction will be described later.

(Bootstrap Function)

The pixel 20 illustrated in FIG. 3 further has the bootstrap function. That is, the horizontal drive circuit 60 stops supplying the scan signal WS (any of WS1 to WSm) to the scan line 31 (any of 31-1 to 31-m) when the holding capacitance 24 holds the input signal voltage Vsig. This causes the write transistor 23 to stop conducting, electrically separating the gate of the drive transistor 22 from the signal line 33 (any of 33-1 to 33-n). As a result, a gate potential Vg of the drive transistor 22 changes with change in a source potential Vs thereof. This maintains the gate-to-source voltage Vgs of the drive transistor 22 constant.

(Circuit Operation)

Figure 6:
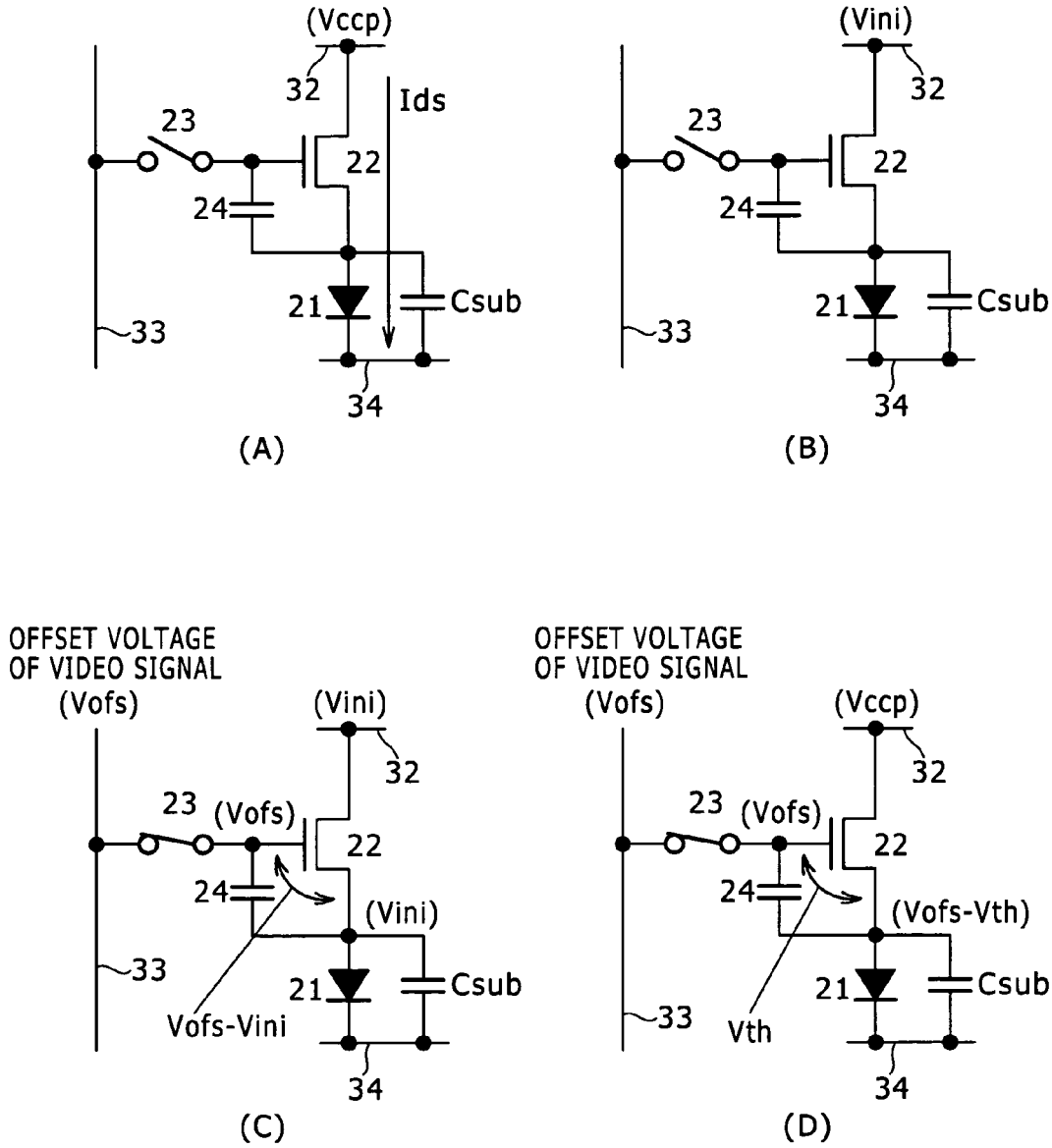
FIG. 6 shows explanatory diagrams (1) of the circuit operation of the organic EL display apparatus according to an embodiment of the present invention.
Figure 7:
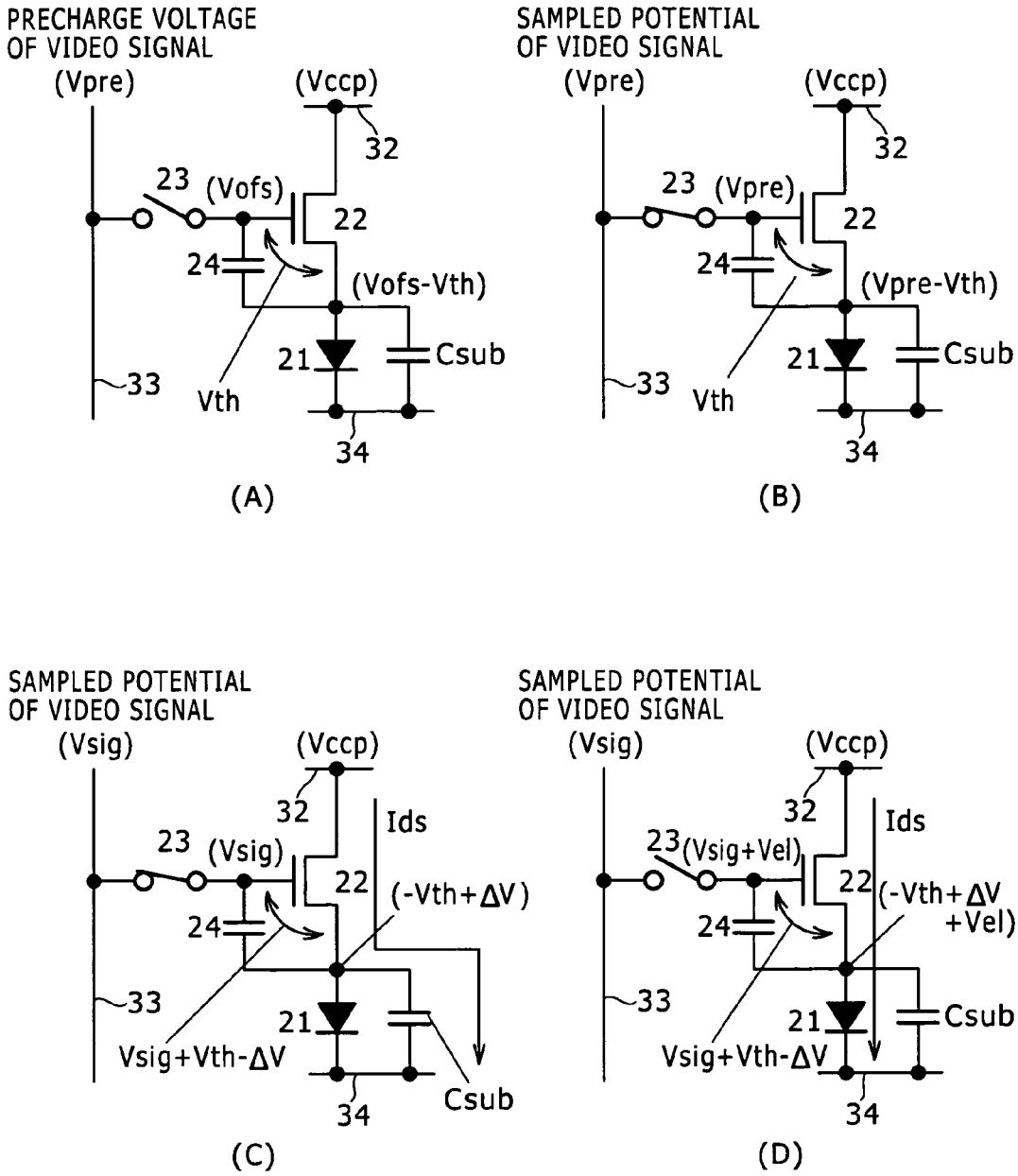
FIG. 7 shows explanatory diagrams (2) of the circuit operation of the organic EL display apparatus according to an embodiment of the present invention.

Next, a description will be given below about the circuit operation of the organic EL display apparatus 10 according to the present embodiment based on the timing diagram shown in FIG. 5 and with reference to the explanatory diagrams shown in FIGS. 6 and 7. It should be noted that the write transistor 23 is represented by a switch symbol in FIGS. 6 and 7 for simplification of the drawings. It should also be noted that the organic EL element 21 has a parasitic capacitance and that the parasitic capacitance and auxiliary capacitance 25 are represented by a combined capacitance Csub.

Figure 5:
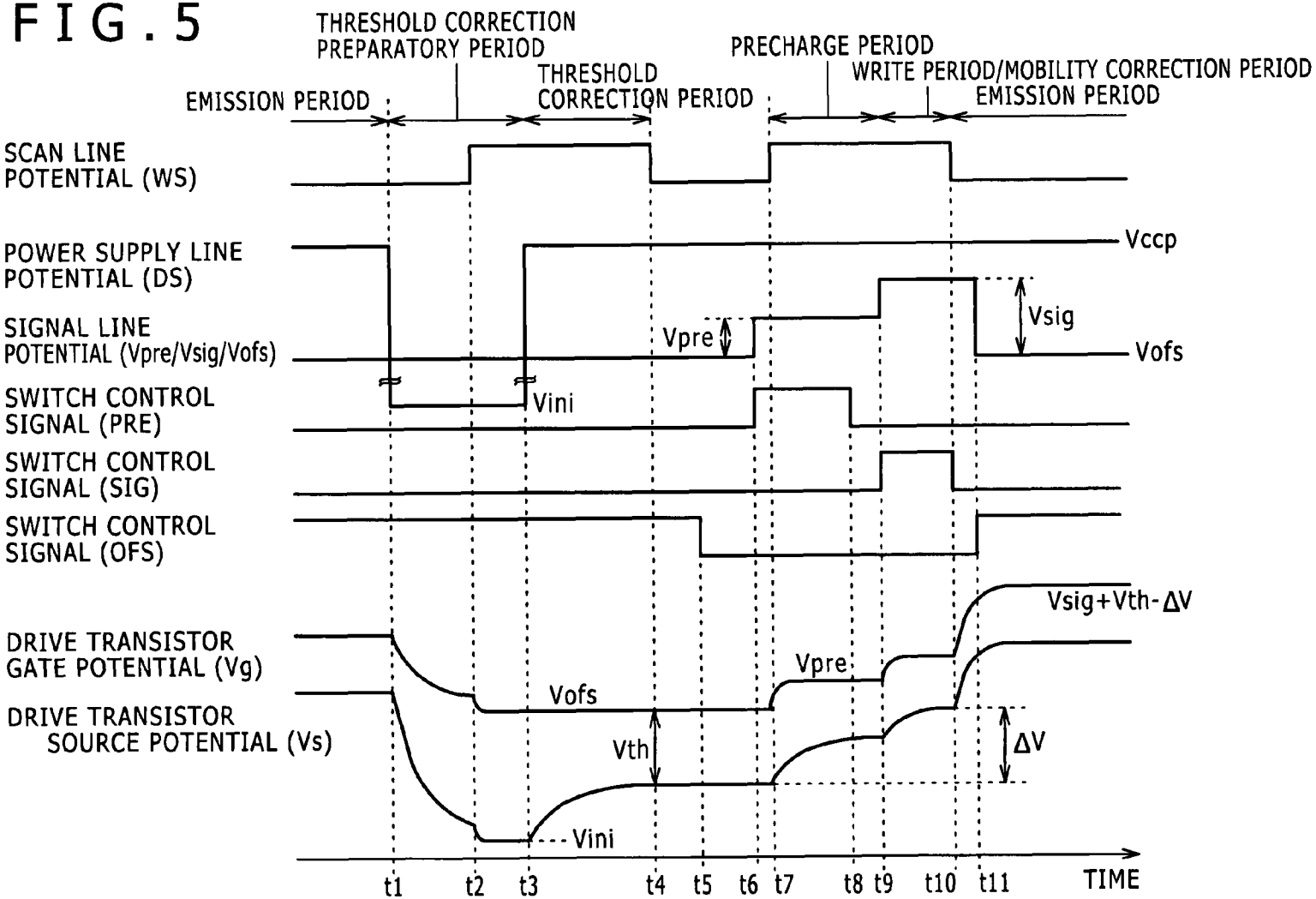
FIG. 5 is a timing diagram for describing the operation of the organic EL display apparatus according to an embodiment of the present invention.

The timing diagram of FIG. 5 shows, on a common time axis, the changes of the potential (scan signal) WS of the scan line 31 (any of 31-1 to 31-m), the potential DS of the power supply line 32 (any of 32-1 to 32-m), the potential (Vpre/Vsig/Vofs) of the signal line 33 (any of 33-1 to 33-n), the switch control signals (PRE, SIG and OFS), and the gate and source potentials Vg and Vs of the drive transistor 22 for a period of 1H (H represents the horizontal scan period).

<Emission Period>

In the timing diagram of FIG. 5, the organic EL element 21 emits light before time t1 (emission period). During this emission period, the potential DS of the power supply line 32 is at the high potential Vccp (first potential). As illustrated in FIG. 6(A), the drive current (drain-to-source current) Ids is supplied to the organic EL element 21 from the power supply line 32 via the drive transistor 22. As a result, the organic EL element 21 emits light at the brightness commensurate with the drive current Ids.

<Preparation Period for Threshold Correction>

At time t1, the linear sequential scan of a new field begins. When the potential DS of the power supply line 32 changes from the high potential Vccp to the low potential Vini (second potential) which is sufficiently lower than the offset voltage Vofs of the signal line 33, the source potential Vs of the drive transistor 22 also begins to drop to the low potential Vini.

Next, the write scan circuit 40 outputs the scan signal WS at time t2, changing the potential WS of the scan line 31 to the high potential. As a result, the write transistor 23 starts conducting as illustrated in FIG. 6(C). At this time, the horizontal drive circuit 60 supplies the offset voltage Vofs to the signal line 33. As a result, the gate potential Vg of the drive transistor 22 becomes equal to the offset voltage Vofs. On the other hand, the source potential Vs of the drive transistor 22 is at the low potential Vini which is sufficiently lower than the offset voltage Vofs.

Here, the low potential Vini is set so that the gate-to-source voltage Vgs of the drive transistor 22 is greater than the threshold voltage Vth of the same transistor 22. As described above, preparations for threshold voltage correction are complete when the gate and source potentials Vg and Vs of the drive transistor 22 are initialized respectively to the offset voltage Vofs and the low potential Vini.

<Threshold Correction Period>

Next, when the potential DS of the power supply line 32 changes from the low potential Vini to the high potential Vccp at time t3 as illustrated in FIG. 6D, the source potential Vs of the drive transistor 22 begins to increase. The gate-to-source voltage Vgs of the drive transistor 22 will soon become equal to the threshold voltage Vth of the same transistor 22, causing the voltage corresponding to the threshold voltage Vth to be written to the holding capacitance 24.

Here, the period of time during which the voltage corresponding to the threshold voltage Vth is written to the holding capacitance 24 is referred to as a threshold correction period for reasons of convenience. It should be noted that, during the threshold correction period, a potential Vcath of the common power supply line 34 is set so as to bring the organic EL element 21 into a cutoff state. This is intended to ensure that all the current flows into the holding capacitance 24, and none into the organic EL element 21.

Next, the potential WS of the scan line 31 changes to the low potential at time t4. As a result, the write transistor 23 stops conducting. At this time, the gate of the drive transistor 22 is placed into a floating state. However, the gate-to-source voltage Vgs is equal to the threshold voltage Vth of the drive transistor 22. As a result, the drive transistor 22 is in a cutoff state. Therefore, the drain-to-source current Ids does not flow.

<Precharge Period>

At time t5 after the end of the threshold correction period, the switch control signal OFS is deactivated (low potential). Next, at time t6, the switch control signal PRE is activated, turning on the horizontal selector switch 64. As a result, the horizontal drive circuit 60 supplies the precharge voltage Vpre to the signal line 33, as illustrated in FIG. 7(A). This changes the potential of the signal line 33 from the offset voltage Vofs to the precharge voltage Vpre.

Next, at time t7, the scan signal WS is activated. That is, the potential WS of the scan line 31 changes to the high potential, bringing the write transistor 23 into conduction as illustrated in FIG. 7(B). This causes a precharge to be performed which samples and writes the precharge voltage Vpre in advance so as to apply the same voltage Vpre to the gate of the drive transistor 22. And, as the gate potential Vg of the drive transistor 22 becomes equal to the precharge voltage Vpre, the source potential Vs of the same transistor 22 begins to rise.

<Write Period/Mobility Correction Period>

Next, at time t8, the switch control signal PRE is deactivated, turning off the horizontal selector switch 64. Then, at time t9, the switch control signal SIG is activated, turning on the horizontal selector switch 65. As a result, the horizontal drive circuit 60 supplies the signal voltage Vsig of the video signal to the signal line 33, as illustrated in FIG. 7(C). This changes the potential of the signal line 33 from the precharge voltage Vpre to the signal voltage Vsig.

And, the signal voltage Vsig is applied to the gate of the drive transistor 22 via the write transistor 23 which is conducting. The gate potential Vg of the drive transistor 22 becomes equal to the signal voltage Vsig. At this time, the organic EL element 21 is initially in a cutoff state (high impedance state). Therefore, the drain-to-source current Ids of the drive transistor 22 flows into the combined capacitance Csub connected in parallel with the organic EL element 21, thus starting the charging of the combined capacitance Csub.

As the combined capacitance Csub is charged, the source potential Vs of the drive transistor 22 begins to increase. The gate-to-source voltage Vgs of the drive transistor 22 will soon become equal to Vsig+Vth−ΔV. That is, an increment ΔV of the source potential Vs is subtracted from the voltage (Vsig+Vth) held by the holding capacitance 24. In other words, the increment ΔV acts so as to discharge the charge held by the holding capacitance 24. This means that negative feedback is applied. Hence, the increment ΔV of the source potential Vs is a feedback amount of the negative feedback.

As described above, the drain-to-source current Ids flowing through the drive transistor 22 is negative fed back to the gate input of the same transistor 22, namely, to the gate-to-source voltage Vgs. This cancels the dependence of the drain-to-source current Ids of the drive transistor 22 on the mobility μ. That is, the mobility correction is performed to correct the variation of the mobility μ between different pixels.

More specifically, the higher the signal voltage Vsig of the video signal, the larger the drain-to-source current Ids, and therefore, the larger the absolute value of the feedback amount (correction amount) ΔV of the negative feedback. This allows for mobility correction according to the emission brightness level. Further, if we assume that the signal voltage Vsig of the video signal is constant, the larger the mobility μ of the drive transistor 22, the larger the absolute value of the feedback amount ΔV of the negative feedback. This eliminates the variation of the mobility μ between different pixels.

<Emission Period>

Next, the potential WS of the scan line 31 changes to the low potential at time t7 (or, the switch control signal SIG is deactivated at the same time or later). As a result, the write transistor 23 stops conducting (turns off) as illustrated in FIG. 7(D). As a result, the gate of the drive transistor 22 is disconnected from the signal line 33. At the same time, the drain-to-source current Ids begins to flow into the organic EL element 21. As a result, the anode potential of the same element 21 increases with increase in the drain-to-source current Ids.

This increase in the anode potential of the organic EL element 21 is none other than the increase in the source potential Vs of the drive transistor 22. If the source potential Vs of the drive transistor 22 increases, the gate potential Vg of the same transistor 22 increases as well due to the bootstrap operation of the holding capacitance 24. At this time, the increment of the gate potential Vg is equal to the increment of the source potential Vs. Hence, the gate-to-source voltage Vgs of the drive transistor 22 is maintained constant at Vsig+Vth−LV during the emission period.

Then, at time t11, the switch control signal OFS is activated, turning on the horizontal selector switch 66. As a result, the horizontal drive circuit 60 supplies the offset voltage Vofs to the signal line 33. This changes the potential of the signal line 33 from the signal voltage Vsig of the video signal to the offset voltage Vofs.

(Principle of the Threshold Correction)

Here, a description will be given below about the principle of the threshold correction of the drive transistor 22. The drive transistor 22 operates as a constant current source as it is designed to operate in the saturated region. This allows the drive transistor 22 to supply a constant level of the drain-to-source current (drive current) Ids, given by the following equation (1), to the organic EL element 21.

$$Ids=(1/2)\cdot\mu(W/L)\mathrm{Cox}(Vgs-Vth)2 \quad (1)$$

where W is the channel width of the drive transistor 22, L the channel length and Cox the gate capacitance per unit area.

Figure 8:
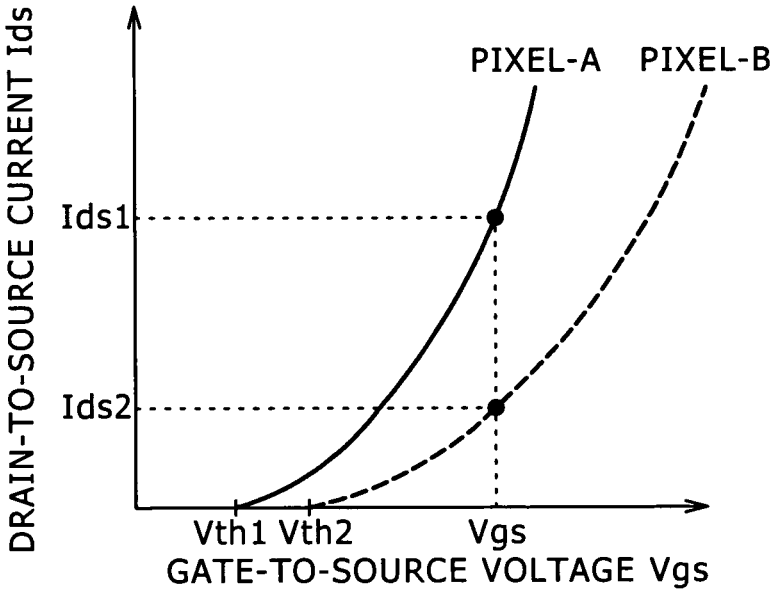
FIG. 8 is a characteristic chart for describing the problem resulting from the variation of a threshold voltage Vth of a drive transistor.

FIG. 8 illustrates the characteristic of the drain-to-source current Ids vs the gate-to-source voltage Vgs of the drive transistor 22. As illustrated in this characteristic chart, without the correction of the variation of the threshold voltage Vth of the drive transistor 22, when the threshold voltage Vth is Vth1, the drain-to-source current Ids associated with the gate-to-source voltage Vgs is Ids1. On the other hand, when the threshold voltage Vth is Vth2 (Vth2>Vth1), the drain-to-source current Ids associated with the same gate-to-source voltage Vgs is Ids2 (Ids2<Ids1). That is, if the threshold voltage Vth of the drive transistor 22 changes, the drain-to-source current Ids changes as well even when the gate-to-source voltage Vgs remains constant.

In the case of the pixel (pixel circuit) 20 configured as described above, on the other hand, the gate-to-source voltage Vgs of the drive transistor 22 at the time of emission is Vsig+Vth−ΔV as mentioned earlier. By substituting this into Equation (1), the drain-to-source current Ids can be expressed by the following equation:

$$Ids=(1/2)\cdot(W/L)\mathrm{Cox}(Vsig-\Delta V)2 \quad (2)$$

That is, the term of the threshold voltage Vth of the drive transistor 22 is cancelled. Therefore, the drain-to-source current Ids supplied from the drive transistor 22 to the organic EL element 21 is not dependent upon the threshold voltage Vth of the drive transistor 22. As a result, the drain-to-source current Ids remains unchanged even in the event of a change in the threshold voltage Vth between different pixels due to a manufacturing process variation or secular change. Hence, the emission brightness of the organic EL element 21 also remains unchanged.

(Principle of the Mobility Correction)

Figure 9:
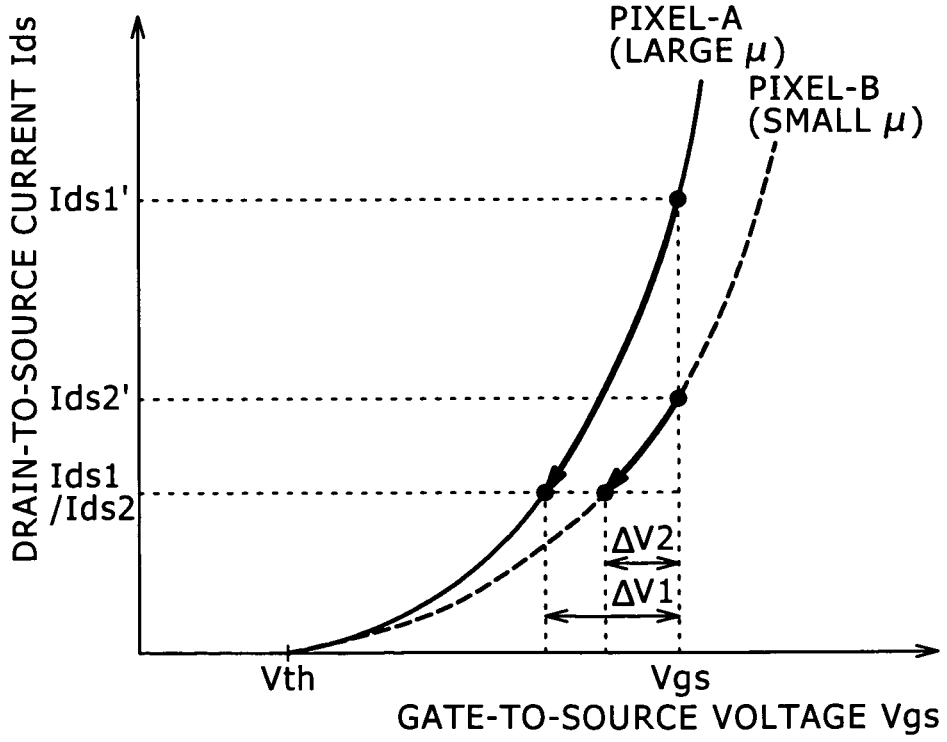
FIG. 9 is a characteristic chart for describing the problem resulting from the variation of a mobility μ of the drive transistor.

Next, a description will be given below about the principle of the mobility correction of the drive transistor 22. FIG. 9 illustrates characteristic curves comparing two pixels. One of the curves represents a pixel A whose drive transistor 22 has a relatively large level of the mobility μ. The other curve represents a pixel B whose drive transistor 22 has a relatively small level of the mobility μ. If the drive transistor 22 is, for example, a polysilicon thin film transistor, the mobility μ inevitably varies between different pixels.

For example, in the case that the same level of the input signal voltage Vsig is written to both the pixels A and B when the mobility μ is different between the two pixels, if any correction is not performed on the mobility μ, there will be a large difference between a drain-to-source current Ids1' flowing into the pixel A with the larger mobility μ and a drain-to-source current Ids2' flowing into the pixel B with the smaller mobility μ. Thus, a large difference in the drain-to-source current Ids between pixels due to a variation of the mobility μ will impair the uniformity over the screen.

As is clear from Equation (1) relating to the transistor characteristic, the larger the mobility μ, the larger the drain-to-source current Ids. Therefore, the larger the mobility μ, the larger the feedback amount ΔV of the negative feedback. As illustrated in FIG. 8, a feedback amount AV1 of the pixel A with the larger mobility μ is greater than a feedback amount AV2 of the pixel B with the smaller mobility μ. For this reason, the mobility correction negative feeds back the drain-to-source current Ids of the drive transistor 22 to the input signal voltage Vsig. As a result, the larger the mobility μ, the more the drain-to-source current Ids is negative fed back. This suppresses the variation of the mobility μ.

More specifically, if the pixel A with the larger mobility μ is corrected using the feedback amount ΔV1, the drain-to-source current Ids drops significantly from Ids1' to Ids1. On the other hand, the feedback amount ΔV2 of the pixel B with the smaller mobility μ is small. Therefore, the drain-to-source current Ids drops only from Ids2' to Ids2, which is not a significant decline. As a result, the drain-to-source current Ids1 of the pixel A becomes approximately equal to the drain-to-source current Ids2 of the pixel B, thus correcting the variation of the mobility μ.

Summing up the above, if the pixels A and B have different values of the mobility μ, the feedback amount ΔV1 of the pixel A with the larger mobility μ is larger than the feedback amount ΔV2 of the pixel B with the smaller mobility μ. That is, the larger the mobility μ of the pixel, the larger the feedback amount LV, and the more the drain-to-source current Ids decreases. That is, the drain-to-source current Ids of the drive transistor 22 is negative fed back to the input signal voltage Vsig. This provides different pixels having different levels of the mobility μ with a uniform level of the drain-to-source current Ids, thus allowing the variation of the mobility μ to be corrected.

Here, a description will be given below about the relationship between the signal potential (sampled potential) Vsig of the video signal and the drain-to-source current Ids of the drive transistor 22 in the pixel (pixel circuit) 20 illustrated in FIG. 3. The relationship will be described comparing the cases with and without the threshold and mobility corrections with reference to FIG. 10.

Figure 10:
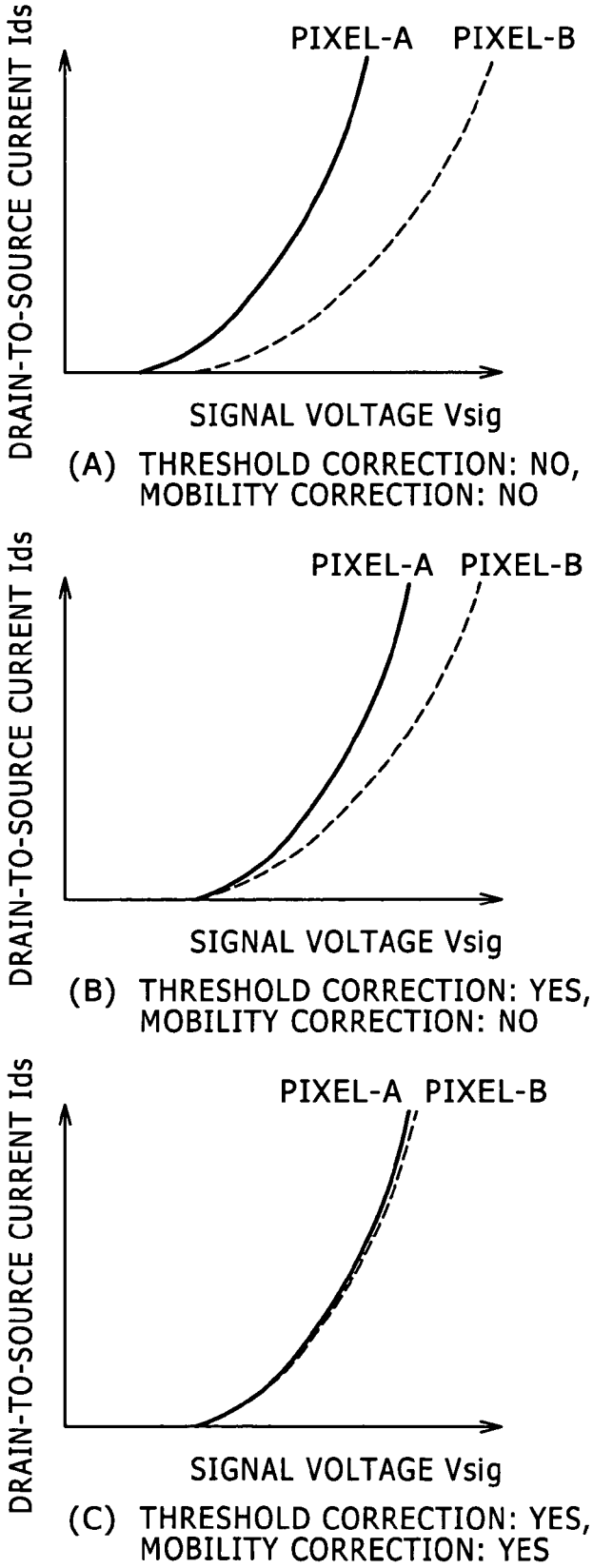
FIG. 10 shows characteristic charts for describing the relationship between a signal voltage Vsig of video signal and a drain-to-source current Ids of the drive transistor comparing three cases with and without threshold and mobility corrections.

In FIG. 10, (A) illustrates the case without the threshold or mobility correction. (B) illustrates the case with the threshold correction but without the mobility correction. (C) illustrates the case with both the threshold and mobility corrections. As illustrated in FIG. 10(A), if neither of the threshold and mobility corrections is performed, there is a large difference in the drain-to-source current Ids between the pixels A and B because of the variations in the threshold voltage Vth and the mobility μ between the two pixels.

In contrast, if only the threshold correction is performed, the variation of the drain-to-source current Ids can be reduced to a certain extent by this threshold correction as illustrated in FIG. 10(B). However, there is still a difference in the drain-to-source current Ids between the pixels A and B attributable to the variation of the mobility μ between the two pixels. When both the threshold and mobility corrections are performed, it is possible to almost completely eliminate the difference in the drain-to-source current Ids between the pixels A and B attributable to the variations of the threshold voltage Vth and the mobility μ between the two pixels as shown in FIG. 10(C). As a result, the brightness of the organic EL element 21 remains unchanged for all shades, thus providing excellent on-screen image.

(Operation and Effect of the Present Embodiment)

In the organic EL display apparatus 10 according to the present embodiment described above, there is a relationship between the optimal mobility correction time for the mobility correction to provide the best image quality and the gate-to-source voltage Vgs of the drive transistor 22 at the beginning of the correction. That is, the higher the gate-to-source voltage Vgs, the shorter the optimal mobility correction time. In other words, the lower the gate-to-source voltage Vgs, the longer the optimal mobility correction time.

In consideration of the relationship between the optimal mobility correction time and gate-to-source voltage Vgs at the beginning of the correction, the organic EL display apparatus 10 according to the present embodiment is characterized in that, prior to increasing the level of the input signal voltage (voltage of the signal line 33) to be sampled in a step-by-step manner and writing the signal voltage Vsig at a desired voltage level, the same apparatus 10 performs a precharge adapted to write the precharge voltage Vpre, lower than the signal voltage Vsig, so as to apply the same voltage Vpre to the gate of the drive transistor 22 in advance.

As described above, performing a precharge with the precharge voltage Vpre ahead of the writing of the signal voltage Vsig causes the gate potential Vg of the drive transistor 22 to increase to the precharge voltage Vpre. The source potential Vs will also increase with increase in the gate potential Vg. The increase in the source potential Vs keeps the gate-to-source voltage Vgs of the drive transistor 22 at the time of writing of the signal voltage Vsig, i.e., at the beginning of the mobility correction period, lower (smaller) than if the precharge were not performed.

And, as the gate-to-source voltage Vgs of the drive transistor 22 at the beginning of the mobility correction period becomes smaller, the optimal mobility correction time will be longer. That is, the mobility correction time can be extended longer than if the precharge were not performed. The longer optimal mobility correction time ensures a relatively smaller variation in the mobility correction time, thus suppressing the variation in brightness attributable to the variation in the mobility correction time.

Further, the longer optimal mobility correction time permits the width (period from time t9 to t10 in FIG. 5) of the scan signal WS, serving as a write pulse, to be set to the optimal width even if a system configuration in which the mobility correction time is determined by a unit of master clock pulse width serving as a reference of system operation is adapted.

It should be noted that, in the aforementioned embodiment, a case has been described as an example where the embodiment is applied to the organic EL display apparatus using the organic EL elements as light-emitting elements of the pixels (pixel circuits) 20. However, the present invention is not limited thereto but is applicable to display apparatuses in general using current-driven light-emitting elements (light-emitting elements) whose emission brightness changes with change in current flowing through the elements.

APPLICATION EXAMPLES

The aforementioned display apparatus according to the present invention is applicable to display apparatuses of electronic equipment used in all fields which is designed to display the image or video of the video signal input to or generated therein. Among such electronic equipment are a wide variety of different equipment illustrated in FIGS. 11 to 15, namely, a digital camera, laptop personal computer, mobile terminal device such as mobile phone, and video camcorder. A description will be given below about examples of electronic equipment to which the present invention is applied.

It should be noted that among the display apparatuses according to the present invention are those in a modular form having a sealed configuration. A display apparatus which fits into this category is a display module formed by attaching a transparent opposed section made of glass or other material to the pixel array section 30. This transparent opposed section may have a color filter, protective film or even a light-shielding film. It should be noted that the display module may have a circuit section, FPC (flexible printed circuit) or other circuitry provided for exchange of signals between the pixel array section and external equipment.

Figure 11:
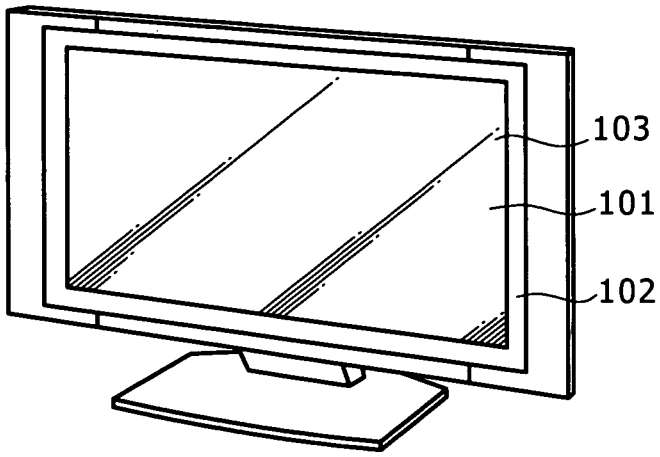
FIG. 11 is a perspective view illustrating a television set to which the present invention is applied.

FIG. 11 is a perspective view illustrating a television set to which the present invention is applied. The television set according to the present application example includes a video display screen section 101 which includes a front panel 102, a filter glass 103 and other components. This television set is manufactured by using the display apparatus according to the present invention as the video display screen section 101.

Figure 12:
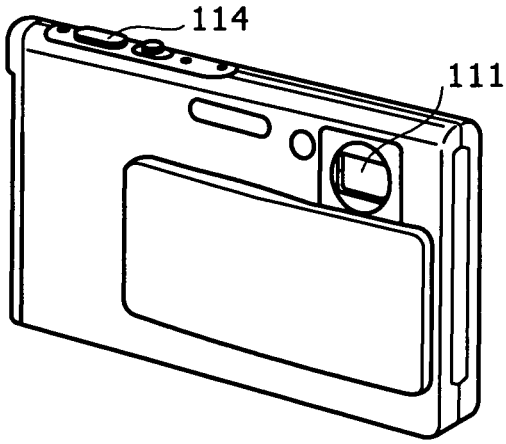
FIG. 12 shows perspective views illustrating a digital camera to which the present invention is applied, (A) is a perspective view as seen from the front of the camera, and (B) is a perspective view as seen from the rear thereof.
Figure 12:
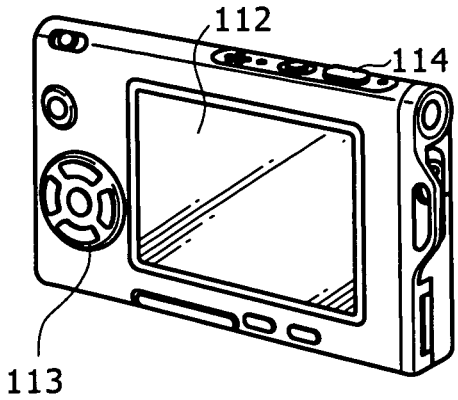

FIG. 12 shows perspective views illustrating a digital camera to which the present invention is applied. (A) is a perspective view as seen from the front of the camera. (B) is a perspective view as seen from the rear thereof. The digital camera according to the present application example includes a flash light-emitting section 111, a display section 112, a menu switch 113, a shutter button 114 and other components. This digital camera is manufactured by using the display apparatus according to the present invention as the display section 112.

Figure 13:
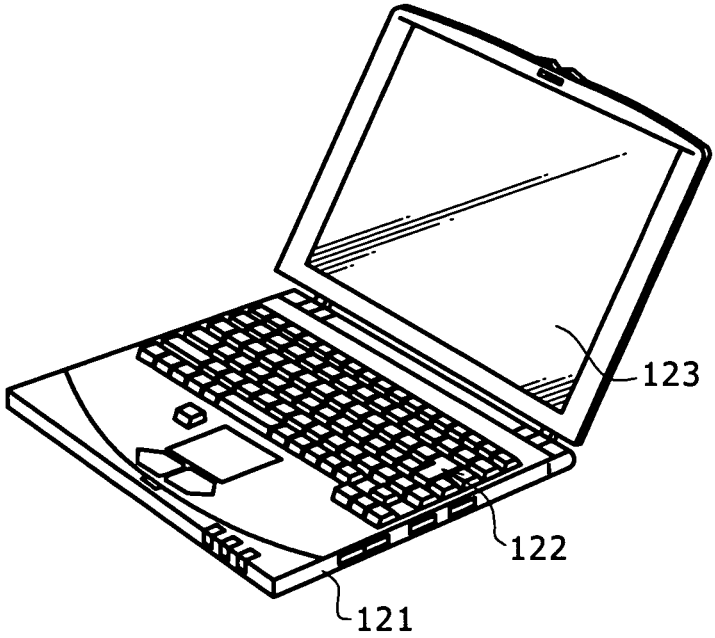
FIG. 13 is a perspective view illustrating a laptop personal computer to which the present invention is applied.

FIG. 13 is a perspective view illustrating a laptop personal computer to which the present invention is applied. The laptop personal computer according to the present application example includes a main body 121, a keyboard 122 adapted to be operated to enter information such as characters, a display section 123 adapted to display images and other components. This laptop personal computer is manufactured by using the display apparatus according to the present invention as the display section 123.

Figure 14:
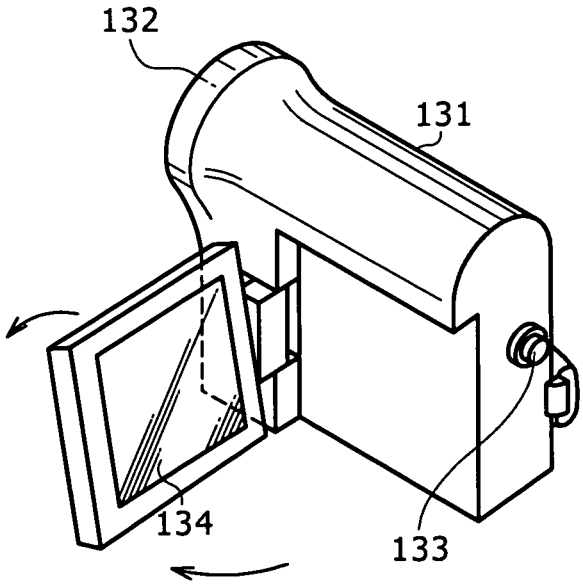
FIG. 14 is a perspective view illustrating a video camcorder to which the present invention is applied.

FIG. 14 is a perspective view illustrating a video camcorder to which the present invention is applied. The video camcorder according to the present application example includes a main body section 131, a front-facing lens 132 adapted to capture the subject image, a start/stop switch 133 for image capture, a display section 134 and other components. This video camcorder is manufactured by using the display apparatus according to the present invention as the display section 134.

Figure 15:
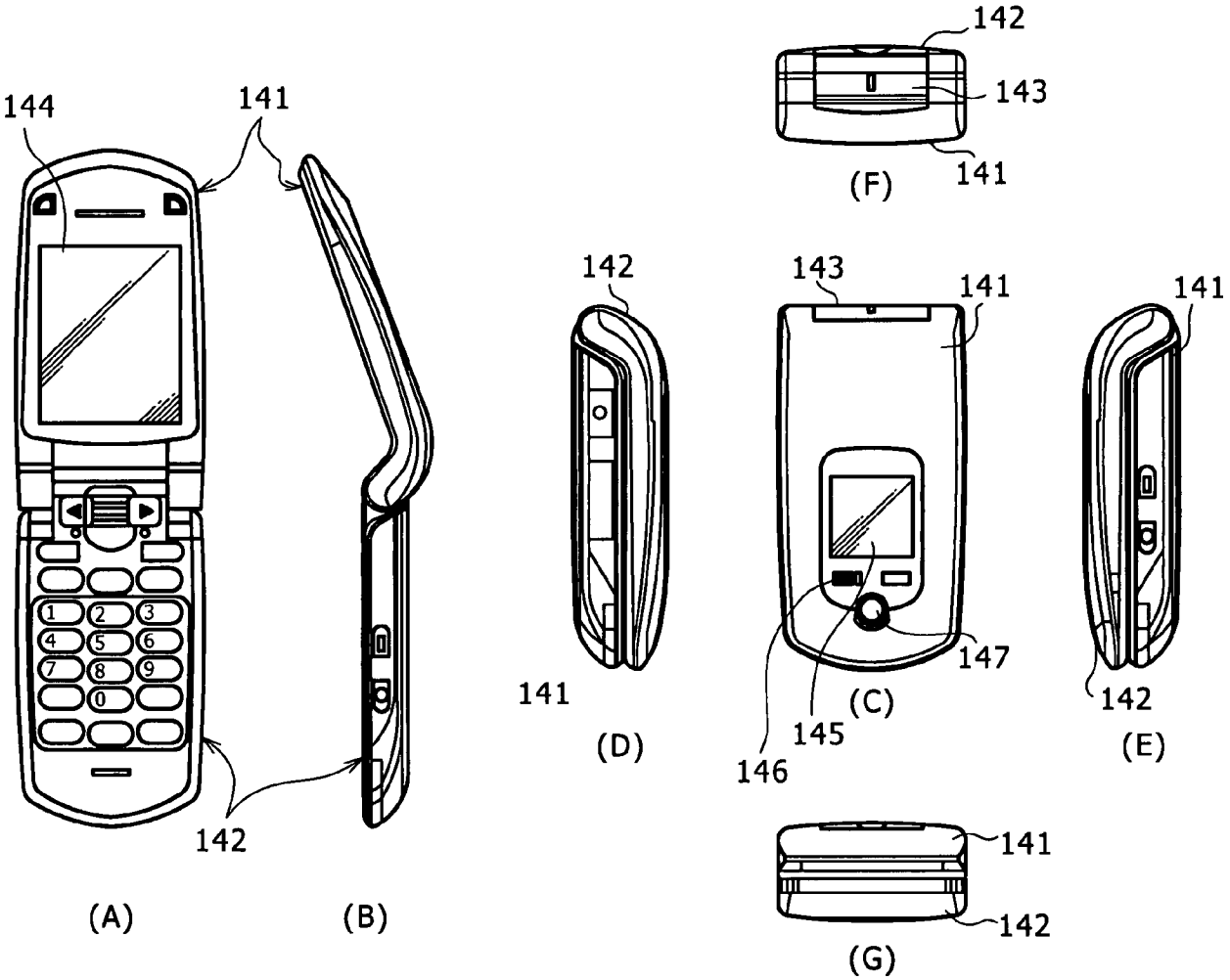
FIG. 15 shows perspective views illustrating a mobile phone to which the present invention is applied, (A) is a front view of the mobile phone as opened, (B) is a side view thereof, (C) is a front view of the mobile phone as closed, (D) is a left side view, (E) is a right side view, (F) is a top view and (G) is a bottom view.

FIG. 15 shows perspective views illustrating a mobile terminal device such as mobile phone to which the present invention is applied. (A) is a front view of the mobile phone as opened. (B) is a side view thereof. (C) is a front view of the mobile phone as closed. (D) is a left side view. (E) is a right side view. (F) is a top view. (G) is a bottom view. The mobile phone according to the present application example includes an upper enclosure 141, a lower enclosure 142, a connecting section (hinge section in this case) 143, a display 144, a subdisplay 145, a picture light 146, a camera 147 and other components. This mobile phone is manufactured by using the display apparatus according to the present invention as the display 144 and the subdisplay 145.

The present invention extends the optimal mobility correction time, thus ensuring a relatively smaller variation in the mobility correction time. This suppresses the variation in brightness attributable to the variation in the mobility correction time and also permits the write pulse to be set to the optimal pulse width.

The invention claimed is:

1. A display apparatus comprising:

a pixel array section including a plurality of pixels, at least one of the plurality of pixels having a light-emitting element, a write transistor configured to write an input signal voltage from a signal line to a holding capacitance during a write period, and a drive transistor configured to drive the light-emitting element based on the input signal voltage held by the holding capacitance;

a drive circuit configured to supply the input signal voltage via the signal lines to the plurality of pixels, wherein within a horizontal scanning period, a potential of the signal line is iteratively increased from an offset voltage, to a pre-charge voltage between the offset voltage and the input signal voltage, and then to the input signal voltage, an increase to the pre-charge voltage occurring before the write transistor is turned on to write the input signal voltage, and at least one of the plurality of pixels performs a correction by negatively feeding back the drain-to-source current of the drive transistor to a gate of the drive transistor during the write period.

2. The display apparatus according to claim 1, wherein after the correction, the potential of the signal line is returned to the offset voltage.

3. The display apparatus according to claim 1, wherein the pixel array section is sequentially scanned on a row-by-row basis, and the signal line corresponds to a given row of pixels, such that within the horizontal scanning period, the potential of the signal line is iteratively increased from the offset voltage, to the pre-charge voltage, and then to the input signal voltage for the given row of pixels.

4. A driving method of a display apparatus, the display apparatus comprising a pixel array section including a plurality of pixels, at least one of the plurality of pixels having a light-emitting element, a write transistor configured to write an input signal voltage from a signal line to a holding capacitance during a write period, and a drive transistor configured to drive the light-emitting element based on the input signal voltage held by the holding capacitance, and a write scan circuit the driving method comprising:

providing the input signal voltage via the signal line to the plurality of pixels, and performing a correction by negatively feeding back the drain-to-source current of the drive transistor to a gate of the drive transistor during the write period, wherein within a horizontal scanning period, a potential of the signal line is iteratively increased from an offset voltage, to a pre-charge voltage between the offset voltage and the input signal voltage, and then to the input signal voltage, an increase to the pre-charge voltage occurring before the write transistor is turned on to write the input signal voltage.

5. The driving method according to claim 4, wherein after the correction, the potential of the signal line is returned to the offset voltage.

6. The driving method according to claim 4, wherein the pixel array section is sequentially scanned on a row-by-row basis, and the signal line corresponds to a given row of pixels, such that within the horizontal scanning period, the potential of the signal line is iteratively increased from the offset voltage, to the pre-charge voltage, and then to the input signal voltage for the given row of pixels.

7. An electronic equipment having a display apparatus, the display apparatus comprising:

a pixel array section including a plurality of pixels, at least one of the plurality of pixels having a light-emitting element, a write transistor configured to write an input signal voltage from a signal line to a holding capacitance during a write period, and a drive transistor configured to drive the light-emitting element based on the input signal voltage held by the holding capacitance;

a drive circuit configured to supply the input signal voltage via the signal line to the plurality of pixels, wherein within a horizontal scanning period, a potential of the signal line is iteratively increased from an offset voltage, to a pre-charge voltage between the offset voltage and the input signal voltage, and then to the input signal voltage, an increase to the pre-charge voltage occurring before the write transistor is turned on to write the input signal voltage, and at least one of the plurality of pixels performs a correction by negatively feeding back the drain-to-source current of the drive transistor to a gate of the drive transistor during the write period.

8. The electronic equipment according to claim 7, wherein after the correction, the potential of the signal line is returned to the offset voltage.

9. The electronic equipment according to claim 7, wherein the pixel array section is sequentially scanned on a row-by-row basis, and the signal line corresponds to a given row of pixels, such that within the horizontal scanning period, the potential of the signal line is iteratively increased from the offset voltage, to the pre-charge voltage, and then to the input signal voltage for the given row of pixels.

* * * * *